US011421711B2

(12) United States Patent
Collins et al.

(10) Patent No.: US 11,421,711 B2
(45) Date of Patent: Aug. 23, 2022

(54) EASY ACCESS FAN MOTOR ASSEMBLIES

(71) Applicant: Heatcraft Refrigeration Products LLC, Richardson, TX (US)

(72) Inventors: Todd Irvin Collins, Williamsport, IN (US); Eric C. Moen, Rising Fawn, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 442 days.

(21) Appl. No.: 16/725,864

(22) Filed: Dec. 23, 2019

(65) Prior Publication Data

US 2021/0190092 A1 Jun. 24, 2021

(51) Int. Cl.

| | |
|---|---|
| ***F04D 29/64*** | (2006.01) |
| ***F04D 29/00*** | (2006.01) |
| ***F04D 29/52*** | (2006.01) |
| ***F04D 29/54*** | (2006.01) |
| ***F25D 17/06*** | (2006.01) |
| ***F04D 29/70*** | (2006.01) |
| ***F04D 29/20*** | (2006.01) |

(Continued)

(52) U.S. Cl.

CPC ..... *F04D 29/644* (2013.01); *F04B 39/121* (2013.01); *F04D 25/06* (2013.01); *F04D 25/12* (2013.01); *F04D 29/002* (2013.01); *F04D 29/20* (2013.01); *F04D 29/263* (2013.01); *F04D 29/522* (2013.01); *F04D 29/547* (2013.01); *F04D 29/703* (2013.01); *F25D 17/067* (2013.01); *F24F 2013/205* (2013.01); *F25D 2317/0681* (2013.01)

(58) Field of Classification Search

CPC ..... F04B 39/121; F04D 25/12; F04D 29/002; F04D 29/644; F04D 29/703; F24F 2013/205

See application file for complete search history.

(56) References Cited

U.S. PATENT DOCUMENTS 2,594,688 A * 4/1952 Shapiro ..... F24F 7/013 55/467
4,063,060 A * 12/1977 Litch, III ..... H02K 5/24 228/128

(Continued)

FOREIGN PATENT DOCUMENTS

| | | |
|---|---|---|
| DE | 202017104300 U1 | 9/2017 |
| KR | 100917119 B1 | 9/2009 |
| WO | 2017086125 A1 | 5/2017 |

OTHER PUBLICATIONS

Partial Search Report and Search Opinion received in European Application No. 20212875.7, dated May 25, 2021, 11 pages.

*Primary Examiner* — J. Todd Newton
*Assistant Examiner* — Brian O Peters
(74) *Attorney, Agent, or Firm* — Johnston IP Law, PLLC

(57) ABSTRACT

In a refrigeration unit for use in cooling a space, such as a walk-in cold space, or other system, an easy access fan motor assembly is provided. A motor mount holds the motor with a plurality of legs that couple to a front panel using stud inserts. In some instances the legs are curved and looked like spider legs. A fan guard member covers the fan and is also attached to the stud inserts. By removing fasteners on the stud inserts, the guard member may be removed and the fan motor assembly may be removed from a position exterior to the refrigeration unit for repair or serving. Other systems and methods are disclosed.

18 Claims, 9 Drawing Sheets

(51) Int. Cl.

| | |
|---|---|
| ***F04B 39/12*** | (2006.01) |
| ***F04D 29/26*** | (2006.01) |
| ***F04D 25/06*** | (2006.01) |
| ***F04D 25/12*** | (2006.01) |
| ***F24F 13/20*** | (2006.01) |

(56) References Cited

U.S. PATENT DOCUMENTS

| | | | | |
|---|---|---|---|---|
| 9,932,990 | B2 * | 4/2018 | Schöne | F24F 13/10 |
| 10,968,920 | B2 * | 4/2021 | Chothave | F04D 29/646 |
| 2006/0067820 | A1 | 3/2006 | Wang et al. | |
| 2019/0346195 | A1 | 11/2019 | Troutman | |

* cited by examiner

EASY ACCESS FAN MOTOR ASSEMBLIES

FIELD

This application is directed, in general, to refrigeration systems, and more specifically, to easy access fan motor assemblies for such systems or other types of systems.

BACKGROUND

Refrigeration systems, e.g., a commercial unit cooler, or other heating ventilating and cooling (HVAC) systems come in many sizes and shapes. One application is a refrigerated storeroom or walk-in unit. These systems include an air mover motor, motor mount, and fan blade. Such systems require access for field installation, periodic servicing, or at times repair. Other systems that include motor mounts, motors, and blades also need access for installation, service, or repair. As used herein, unless the circumstances indicate otherwise, "or" does not require mutual exclusivity.

SUMMARY

According to an illustrative embodiment, a refrigeration unit includes a cabinet having a plurality of panels forming an interior space and a motor having a shaft and a plurality of mounting studs. A first panel of the plurality of panels is formed with a fan aperture therethrough. The refrigeration unit further includes a Venturi shroud that is formed on the first panel around the fan aperture and extends axially outward from the cabinet and a motor mount.

The motor mount includes a central motor mounting member having a plurality of apertures for receiving the plurality of mounting studs on the motor; a plurality of legs, each having a distal end and a proximal end. The proximal ends of the legs are coupled to the central motor mounting member, and the distal ends are coupled to the first panel radially outboard of the fan aperture when in an assembled position. The proximal ends of the plurality of legs are axially closer to the motor than the distal ends of the plurality of legs when in the assembled position. The Venturi shroud is formed with a plurality of slots. Each slot of the plurality of slots is sized to allow one of the plurality of legs of the motor mount to enter the slot.

The refrigeration unit further includes a fan blade coupled to the shaft of the motor; and a guard member coupled to the first panel, wherein the guard member has a convex outward facing portion and a concave interior portion, and wherein the concave interior portion covers the fan blade.

According to another illustrative embodiment, a method for servicing a portion of a refrigeration unit that is of the type referenced in the previous paragraphs is provided. The refrigeration unit includes main nuts applied to the stud inserts outboard of a plurality of guard attachment tabs. The method includes removing the main nuts; removing the guard member; and removing the fan blade, motor, and motor as a unit from an exterior of the cabinet.

According to still another illustrative embodiment, a refrigeration unit includes a cabinet having a front panel; an evaporator coil disposed within an interior of the cabinet; a round fan aperture formed in the front panel; a fan blade; a motor having a shaft extending toward an exterior of the cabinet when in an assembled position and a plurality of attachment studs; and a motor mount having a hub portion and a plurality of legs extending from the hub portion radially outward and axially towards the exterior of the cabinet when in an assembled position, each of the plurality of legs having a first end and a second end, wherein the first ends are coupled to the hub portion. The motor mount hub is coupled to the plurality of attachment studs of the motor. The second ends of the plurality of legs are coupled to the front panel, and in an assembled position, the motor is only supported by the plurality of legs. Other systems, methods, and devices are disclosed herein.

BRIEF DESCRIPTION

Illustrative embodiments of the present disclosure are described in detail below with reference to the attached drawing figures, which are incorporated by reference herein and wherein.

Figure 12:
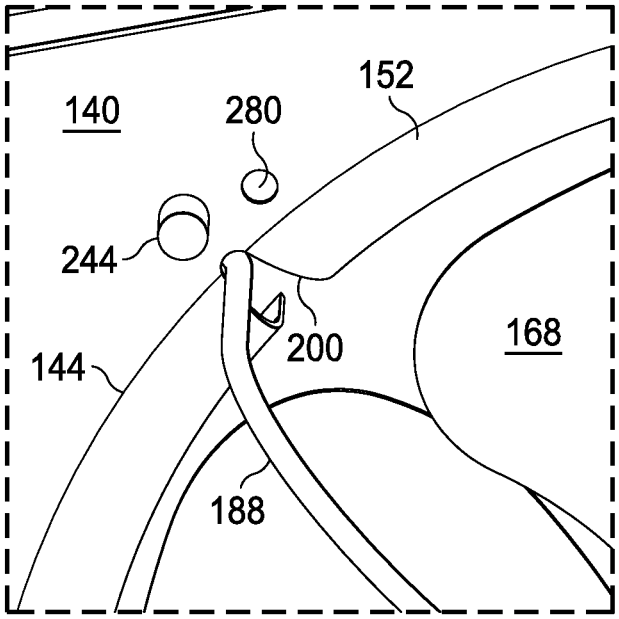
Figure 13:
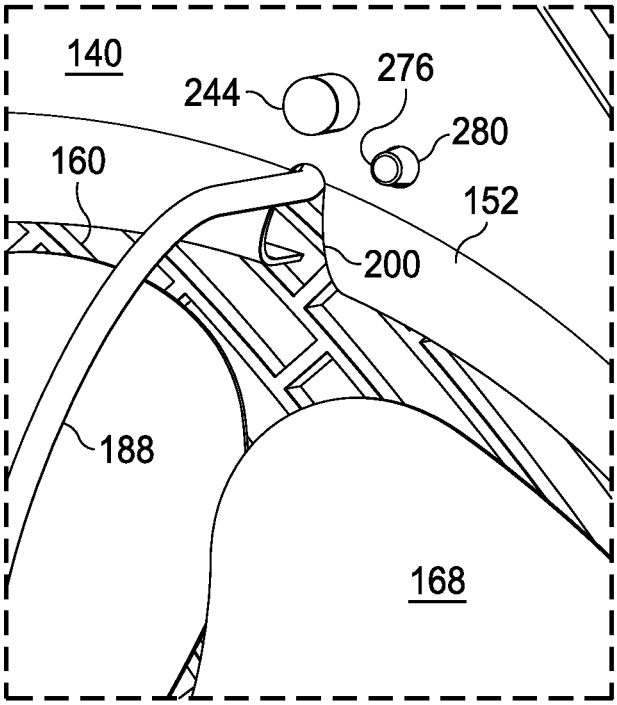

FIG. 12 is a schematic perspective view of a portion of an illustrative embodiment of a refrigeration unit showing the backside of a front panel where a leg of a motor mount goes through a slot in a Venturi shroud and showing an alignment aperture for use with an alignment pin; and FIG. 13 is a schematic perspective view of the portion of a refrigeration unit shown in FIG. 12 from a slightly different angle and with the alignment pin extending through the alignment aperture.

DETAILED DESCRIPTION

Refrigeration systems, e.g., a commercial unit cooler, or other heating ventilating and cooling (HVAC) systems come in many sizes and shapes and have numerous applications. One application is a refrigerated storeroom or walk-in unit, such as may be used by a convenience store, restaurant, warehouse, or grocer. These systems include an air mover motor, motor mount, and fan blade. Such systems require access for field installation, periodic servicing, or at times repair. Other systems that include motor mounts, motors, and blades also need access for installation, service, or repair. Whatever system or repair that is involved with these systems, it is desirable to efficiently access an interior portion and to promote proper assembly or reassembly.

The systems and methods herein may provide for easier access and more reliable assembly. In the past, in a refrigeration system for a walk-in refrigeration unit, if motor replacement was required, the task was time-consuming and uncomfortable for the technician since typically many small fasteners had to be removed while standing on a ladder, often in a cold, poorly lit environment. Other situations and systems also can benefit from easier access and other aspects of the systems, devices, and methods herein.

In at least some embodiments, a fan motor assembly is included that includes a motor mount having a plurality of legs that attach to a front panel to provide support, a guard that couples to the motor mount, and a motor coupling member to which the motor is attached. The front panel may include a member that has slots for receiving a portion of the plurality of legs of the motor mount. In this way, only a small number of fasteners need to be removed to pull out the entire motor assembly from a position exterior to the fan cabinet in front of the fan. An alignment pin system may be included in some embodiments to make proper orientation of the guard assured.

At least some of the systems and methods included herein may facilitate servicing that was previously avoided or less adequate. For example, it is sometimes necessary for a technician to clean the evaporator coil. In the past, at least at times, this was done by directing a water jet around the fan motor, which remained in place, to the evaporator coil. With the ease of motor removal under the systems and methods herein, the technician may now choose to remove the motor assembly to gain clear access to the evaporator coil for better cleaning. In addition, the drain pan may remain in place to capture any cleaning water. Many other applications may utilize the systems and methods.

As previously noted, one example of a system is a walk-in refrigeration system as may be used in a restaurant, convenience store, warehouse, or other situation. An example of such a system is presented in FIG. 1.

Figure 1:
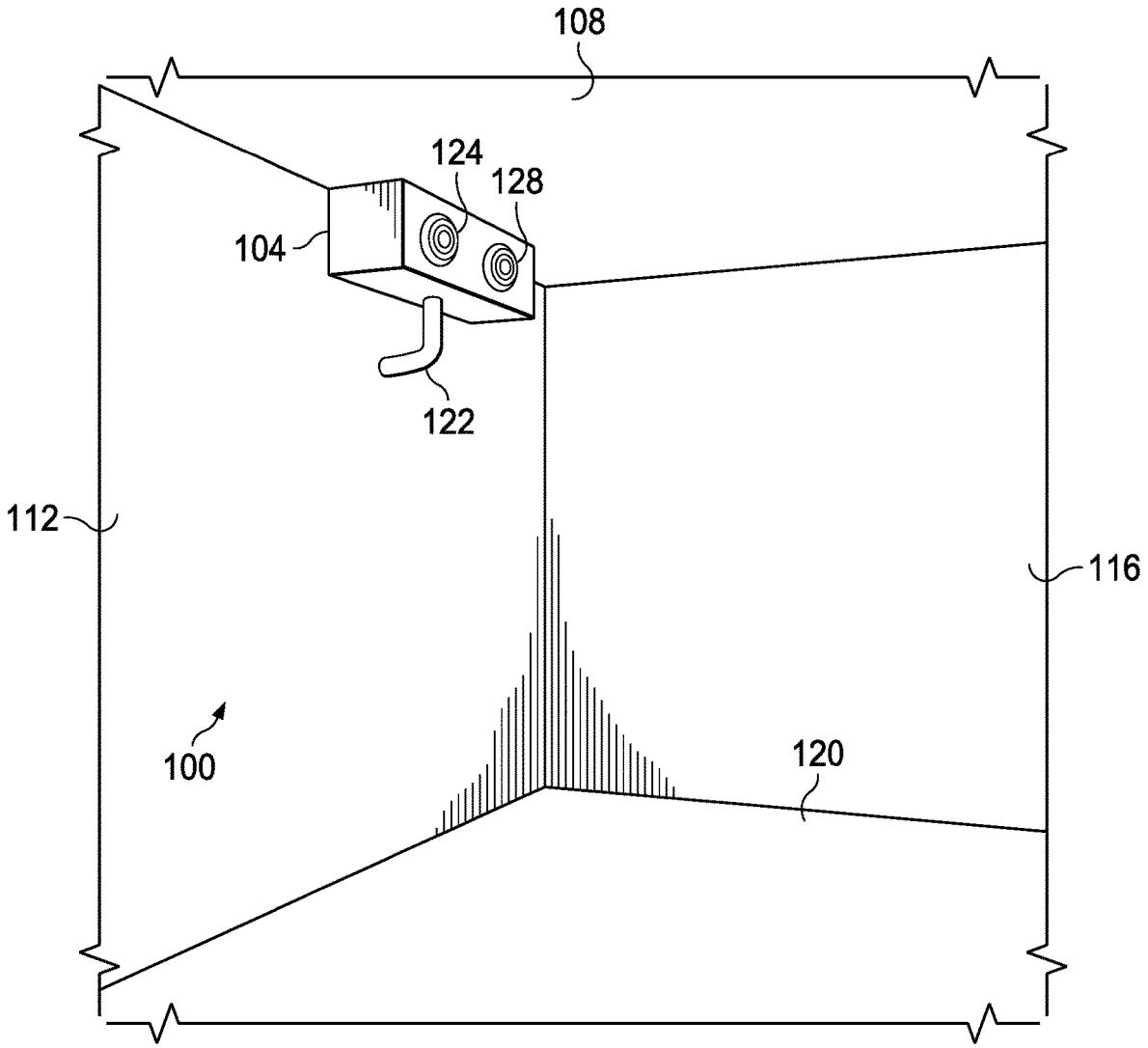
FIG. 1 is a schematic perspective view of an illustrative embodiment of a refrigeration unit inside of a walk-in refrigerated space.

Referring now to the figures and initially to FIG. 1, an illustrative embodiment of a walk-in refrigeration system 100 is presented that includes an illustrative embodiment of a refrigeration unit 104. The refrigeration unit 104 may be a low-profile unit as shown or may take other shapes or be located elsewhere.

The refrigeration unit 104 is shown mounted proximate a ceiling 108 of a walk-in refrigerated room. The room includes a first wall 112, a second wall 116, and a floor 120. Other walls not explicitly shown form a closed spaced that is to be cooled. A drainage line 122 is shown exiting the refrigeration unit 104. The refrigeration unit 104 includes a first fan 124, or air mover, and a second fan 128, or air mover. It should be understood, however, that the refrigeration unit 104 could include any number of fans, e.g., one, two (as shown), three, four, five, six, or some other number.

Figure 2:
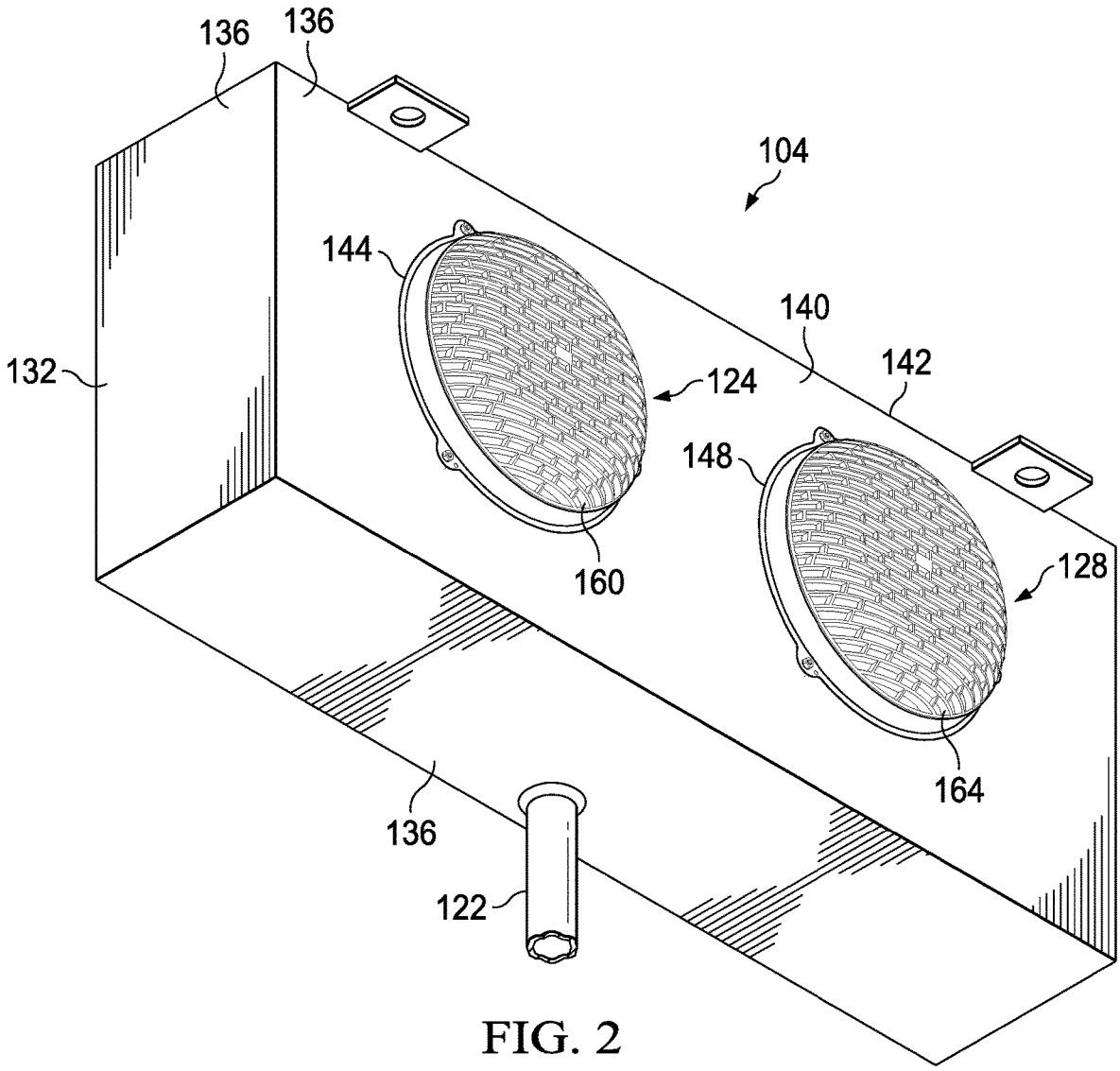
FIG. 2 is a schematic perspective view of the refrigeration unit of FIG. 1.

Referring now primarily to FIG. 2, the refrigeration unit 104 is shown in more detail. The refrigeration unit 104 includes a cabinet 132 formed with a plurality of panels 136, which may include a front panel 140, a back panel, a top panel 142, a bottom panel, a first side panel, and a second side panel. The panels 136 may be formed from subpanels. The front panel 140, or first panel, is formed with a first fan aperture 144 and a second fan aperture 148. A first Venturi shroud 152 (see FIG. 4) may surround the first fan aperture 144, and likewise a second Venturi shroud 156 (analogous to 152 in FIG. 4) may surround the second fan aperture 148. The fan apertures 144 and 148 may be covered by a first guard member 160 and a second guard member 164, respectively. The guard members 160 and 164 have a different grill design than shown in FIG. 1, and those skilled in the art will appreciate that many designs might be used.

As those skilled in the art will appreciate, an evaporator coil is located in the interior 172 (FIG. 3) of the cabinet 132 such that air moved by the fans 124, 128 across the evaporator coils exits through the fan apertures 144, 148 or the evaporator coil as conditioned air. The conditioned air cools the space, e.g., a walk-in room, as desired.

Figure 3:
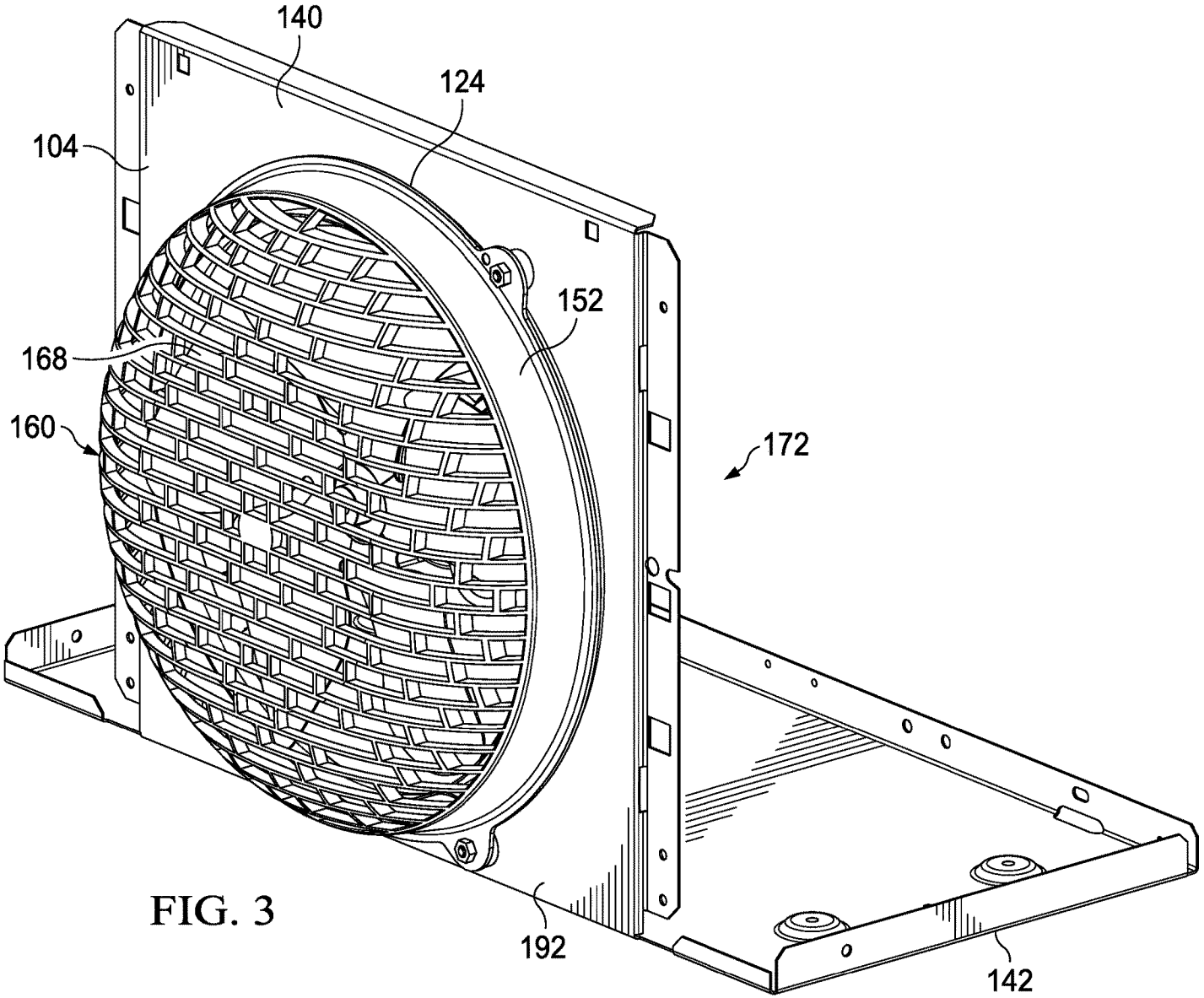
FIG. 3 is a schematic perspective view of a portion of an illustrative embodiment of a refrigeration unit showing a front panel, guard member, and fan motor assembly.

Referring now primarily to FIG. 3, a portion of a single fan refrigeration unit 104 is presented. In this illustrative presentation, the cabinet 136 has been removed except for the front panel (or portion thereof that may be referred to as the same) 140 in order to explain aspects of the embodiment. The refrigeration unit 104 is the same as that shown in FIG. 2 except for with only one fan which will be presented as the first fan 124. In comparing FIGS. 2 and 3, one should note that the refrigeration unit 104 has been flipped vertically such that the top panel 142 in FIG. 2 is now shown on the bottom in FIG. 3. It shown this way because this is how the refrigeration unit 104 is manufactured and assembled so the refrigeration unit 104 can rest on a surface. In this view, one may look through openings in the first guard member 160 and see a first fan blade 168. For clarity purposes, the evaporator coil has been removed from the interior 172, but would be located just behind the fan blade 168.

Figure 4:
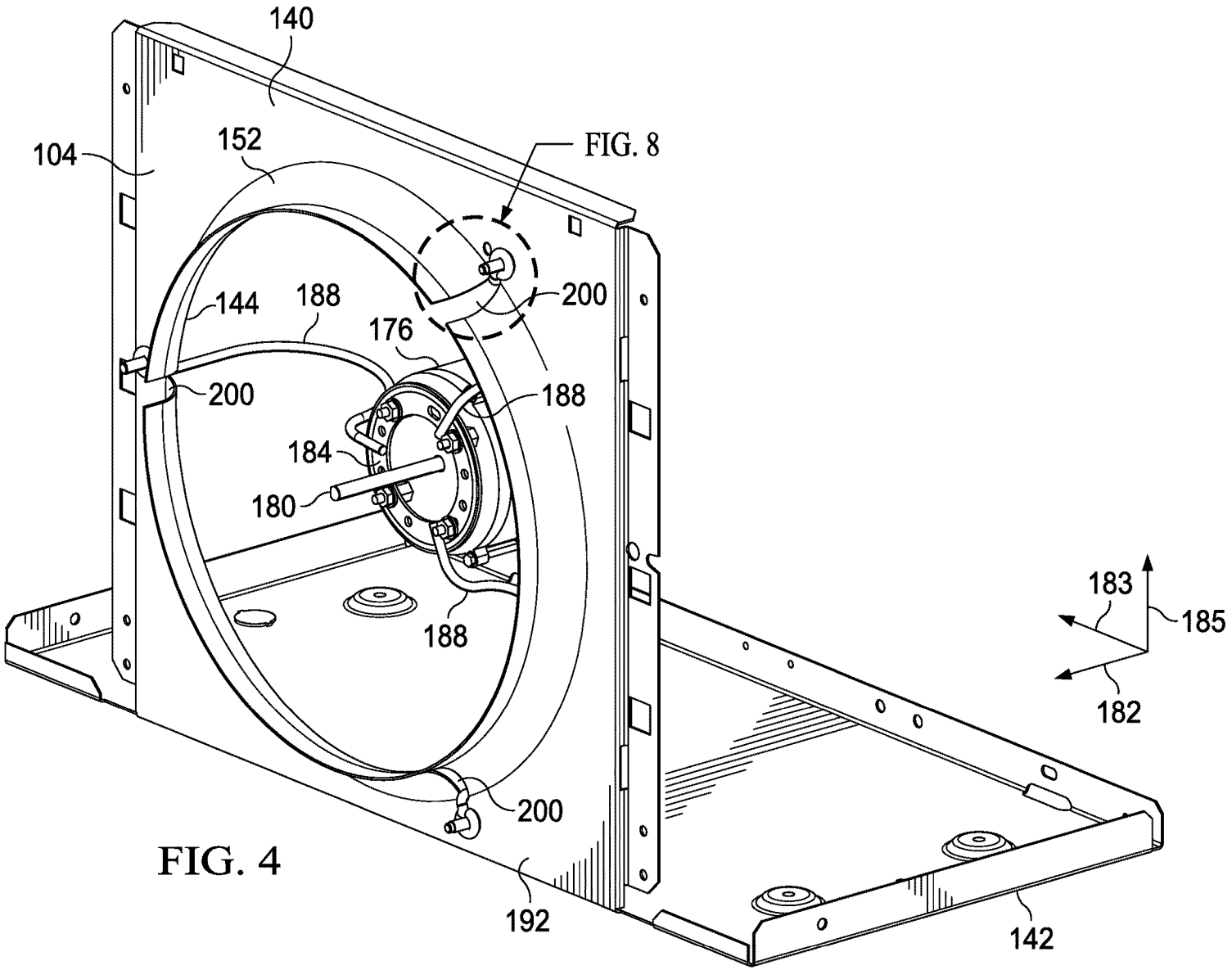
FIG. 4 is a schematic perspective view of the portion of a refrigeration unit shown in FIG. 3 with the guard member and a fan blade removed.

Referring now primarily to FIG. 4, the same refrigeration unit 104 of FIG. 3 is presented with the first guard member 160 and first fan blade 168 removed. In this way, one may see a motor 176 having a shaft 180 that extends axially in a first direction 182, or axial direction. It should be understood that the axial orientation may be in any direction, e.g., horizontal (FIG. 1), vertically downwards, 45 degrees, or another orientation. For convenience, the illustrations will be shown in the context of a horizontal orientation. The first direction 182 (or axially) is parallel to the two side panels of the cabinet 132 and parallel to the motor shaft 180 when in an assembled position. If one is facing the front panel 140, the axial direction 182 would be a direction in and out, and for reference purposes laterally would be a second direction 183 and vertical would be a third direction 185. The motor 176 is suspended by a motor mount 184. The motor mount 184 has a plurality of legs 188 that couple to the first panel or front panel 140. In this view the first Venturi shroud 152 is clearly shown extending axially (parallel to 182) outward from an outwardly facing surface 192 of the front panel 140. The first Venturi shroud 152 constricts in some measure as the Venturi extends outwardly from the panel 140. The Venturi shroud 152 is formed with a plurality of slots 200 that each accommodate a portion of the plurality of legs 188. The motor 176, mount 184, motor shaft 180, fan blade 168, and guard member 168 may be manufactured and serviced as a complete assembly or in any combination of these components.

Figure 5:
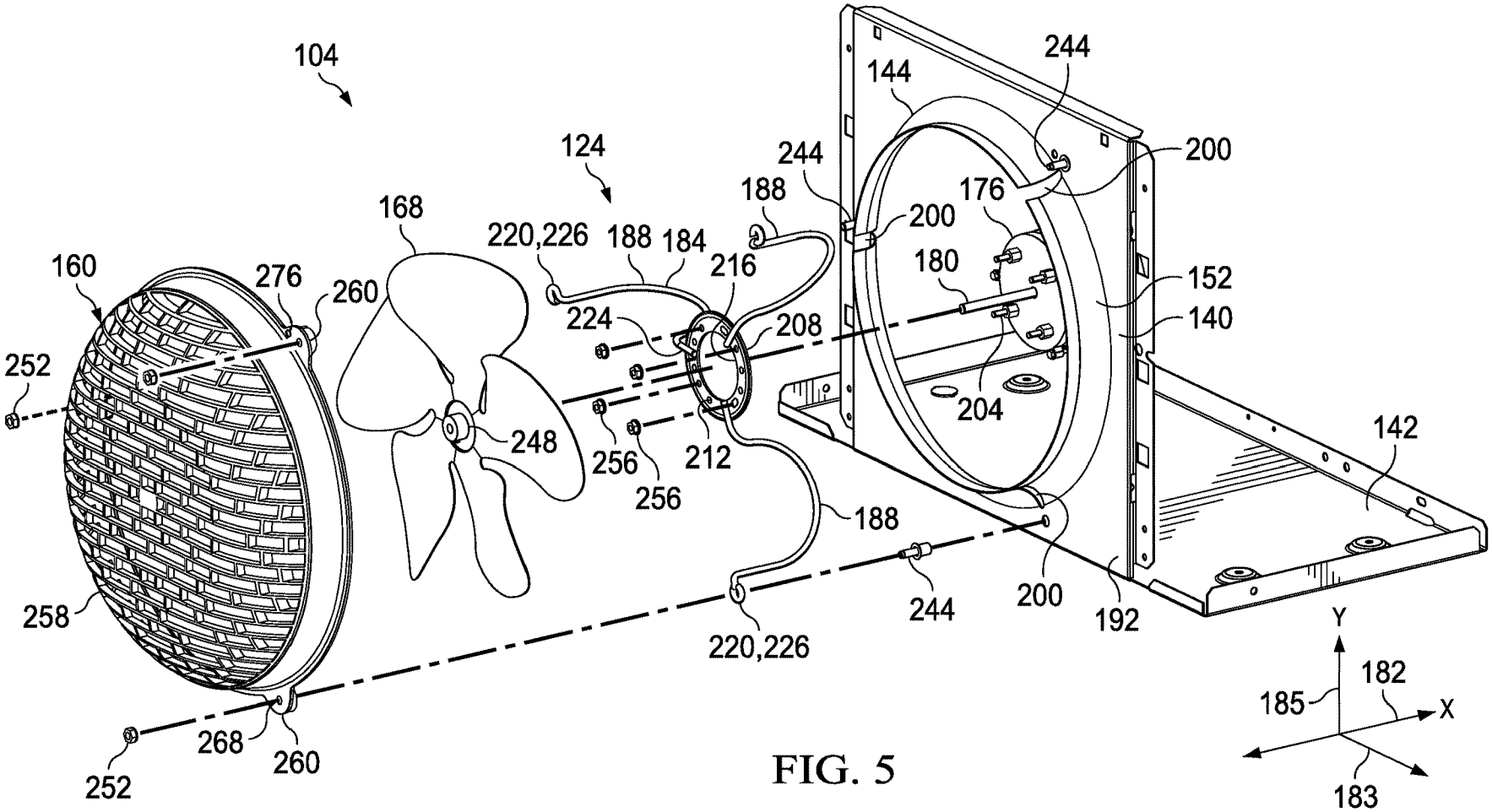
FIG. 5 is a schematic, exploded, perspective view of the portion of the refrigeration unit shown in FIG. 3.

Referring now primarily to FIG. 5, an exploded view of a portion of the refrigeration unit 104 is presented. The motor 176 has the shaft 180 that extends axially 182 outward (towards the outside of the cabinet 132 on the front) when the refrigeration unit 104 is in the assembled position and a plurality of mounting studs 204 that also extend axially outward in an assembled position. The first panel 140 or front panel of the plurality of panels 136 is formed with the fan aperture 144 therethrough. The Venturi shroud 152 is formed on the first panel 140 around the fan aperture 144 and extends axially 182 outward from the front panel 140.

The Venturi shroud 152 angles in as it goes axially outwardly from the panel 140. In another embodiment, the Venturi shroud may be a shroud or skirt that is substantially flush with the front panel 140. In some embodiments, the Venturi shroud 152 may be partially or completely formed as part of the guard member 168.

Figure 6:
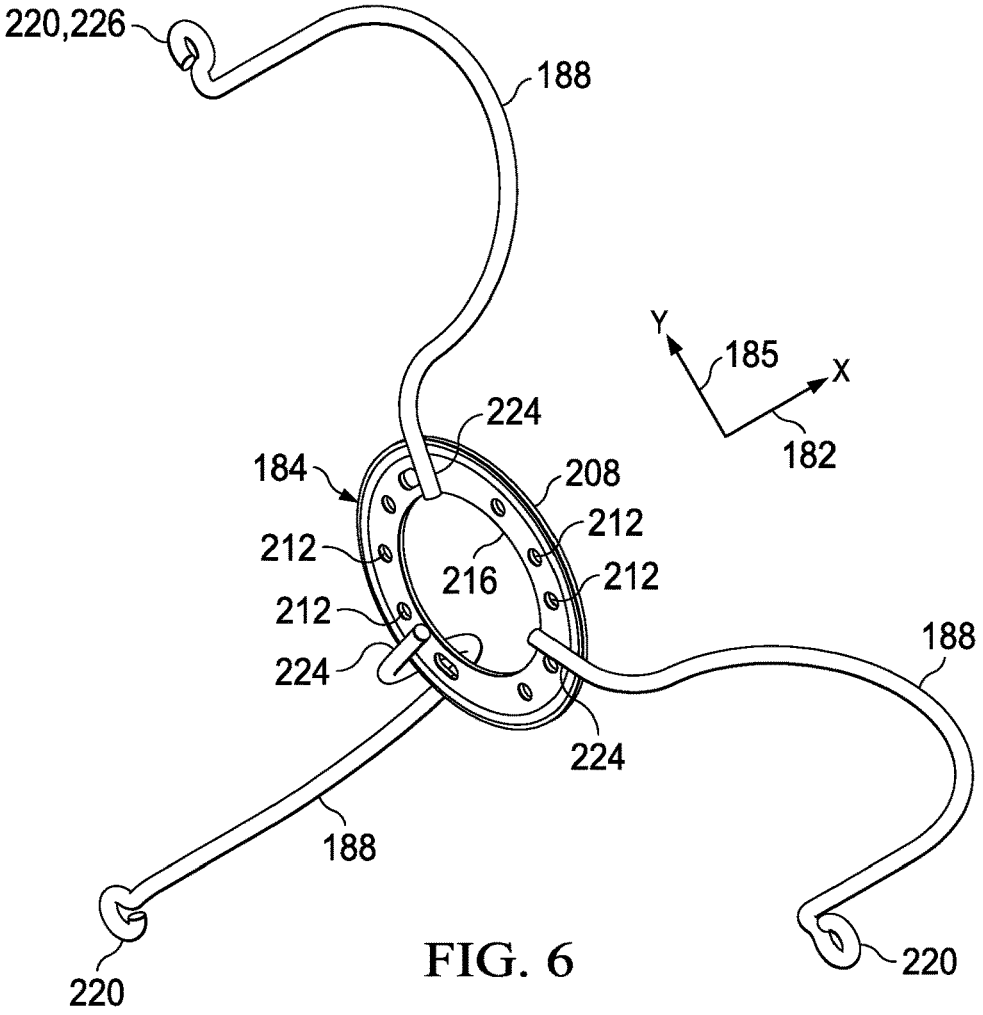
FIG. 6 is a schematic perspective view of an illustrative embodiment of a motor mount for use as part of an illustrative refrigeration unit.

Referring primarily to FIGS. 5 and 6, the motor mount 184 includes a central motor mounting member 208 having a plurality of apertures 212 for receiving the plurality of mounting studs 204 on the motor 176. The central motor mounting member 208 may be circular with an aperture 216 that at a minimum allows the shaft 180 to extend therethrough. In some embodiments, the central motor mounting member 208 may be square or take on other shapes.

The motor mount 184 includes the plurality of legs 188. Each leg of the plurality of legs 188 has a distal end 220 and a proximal end 224. The proximal ends 224 of the legs 188 are coupled to the central motor mounting member 208 by welding, clinching, or fasteners and the distal ends 220 are coupled to the first panel 140 radially outboard of the fan aperture 144 when in the assembled position. "Radially" means going in the direction from the shaft along radials toward an exterior in a plane parallel to the front panel 140. The radial at 90 degrees would be horizontal 183 in FIG. 5. The distal ends may be formed with eyelets 226 that facilitate coupling to a coordinated stud insert 244. Other attachment techniques may be used.

Figure 7:
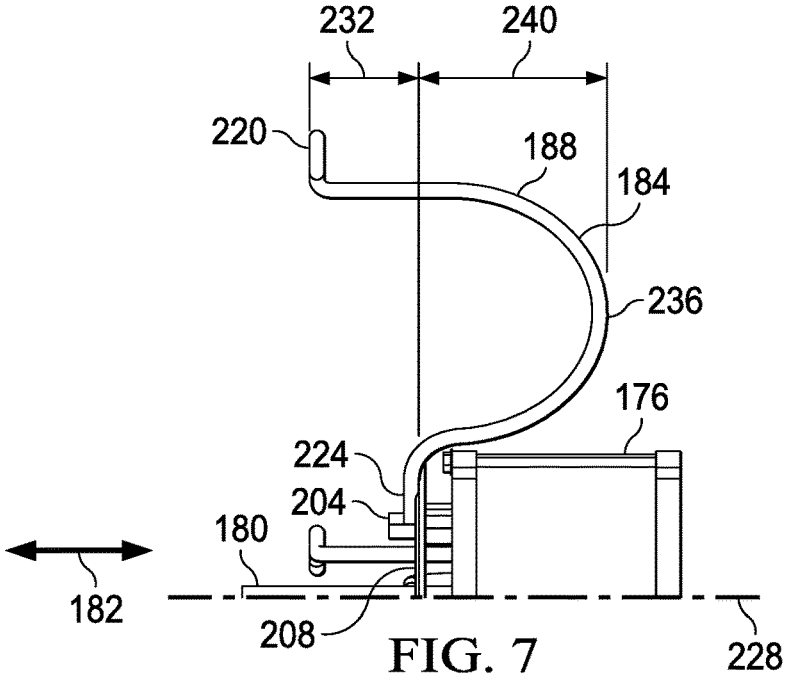
FIG. 7 is a schematic elevation view of a portion of an illustrative embodiment of a fan motor assembly from a centerline up.

Referring now primarily to FIG. 7, a portion of the motor 176 and motor mount 184 are shown taken along an axial center line 228. The proximal ends 224 of the plurality of legs 188 are axially closer to the motor 176 than the distal ends 220 of the plurality of legs 188 when in the assembled position. The distal ends 220 are a distance 232 from a face of the motor 176 while the proximal ends 224 abut the central motor mounting member 208 that abuts the motor 176. In this view, one may see that each leg 188 turns 180 degrees and that the most axially interior portion 236 of the legs 188 is a distance 240 from the front face of the central motor mounting member 208. As shown best in FIGS. 5, 6, and 7, the legs 188 may be a curved shape and may generally resemble spider legs.

In one illustrative embodiment, in the assembled position, the central motor mounting member 208 is displaced parallel to the shaft 180 of the motor 176 a distance 232 of at least 0.25 inches from the distal ends 220 of the plurality of legs 188 of the motor mount 184. Also, the inward distance (232+240) from the distal ends 220 of the plurality of legs 188 to a most inward portion 236 of the plurality of legs 188 is at least 0.5 inches. Those skilled in the art will appreciate that other dimensions may be used in other embodiments.

Figure 8:
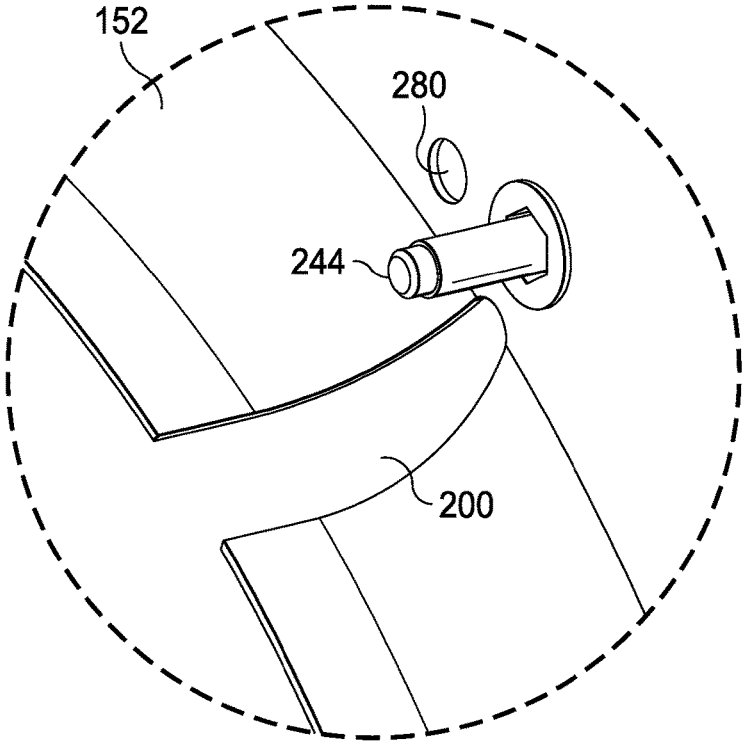
FIG. 8 is a schematic perspective view of a detail from FIG. 4.
Figure 9:
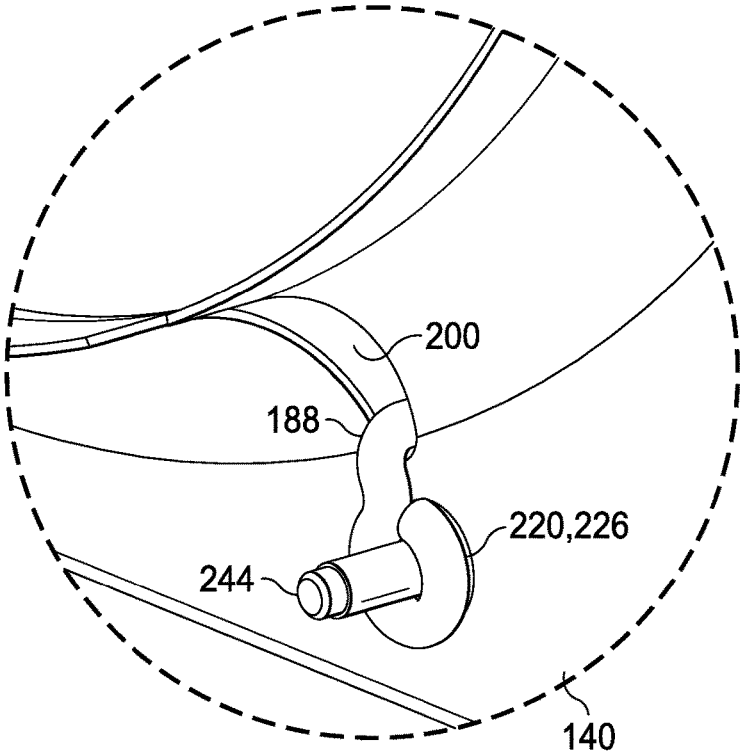
FIG. 9 is a schematic perspective view of a portion of an illustrative embodiment of a refrigeration unit showing the distal end of the leg of a motor mount extending through a slot to attach on a front face of a front panel.

Referring now primarily to FIGS. 5, 8, and 9, the Venturi shroud 152 is formed with the plurality of slots 200. Each slot of the plurality of slots 200 is sized to allow one of the plurality of legs 188 of the motor mount 184 to enter the slot 200. In some embodiments, the slots 200 are V-shaped. FIG. 9 shows one leg 188 in the assembled position extending through slot 200 and interfacing with one of a plurality of stud inserts 244.

The plurality of stud inserts 244 extend outwardly in an axial direction 182 from the first panel 140. As shown best in FIG. 5, the stud inserts 244 are radially outboard of the Venturi shroud 152. Three are shown, but those skilled in the art will appreciate that various numbers may be used. The stud inserts 244 are used to couple the motor mount 184 via legs 188 and the guard member 160 to the first panel 140.

In some embodiments, the stud inserts 244 are threaded and after the motor mount 184 and guard member 160 are disposed about the stud inserts 244, a plurality of main nuts 252 may be applied to complete the coupling. In a similar fashion, the plurality of mounting studs 204 may be threaded and after the central motor mount member 208 is applied over the mounting studs 204, a plurality of nuts 256 may be applied to secure the motor 176. Other fasteners couplings techniques may be used. In some embodiments, a threaded nut insert and bolt may be used.

Referring again primarily to FIG. 5, the fan blade 168 is coupled to the shaft 180 of the motor 176 at an attachment hub 248 of the fan blade 168. The fan blade 168 is protected by the guard member 160. The guard member 160 is coupled to the first panel 140. The guard member 160 has a convex axially outward facing portion and a concomitant concave interior portion. The concave interior portion receives or covers the fan blade 168.

Figure 10:
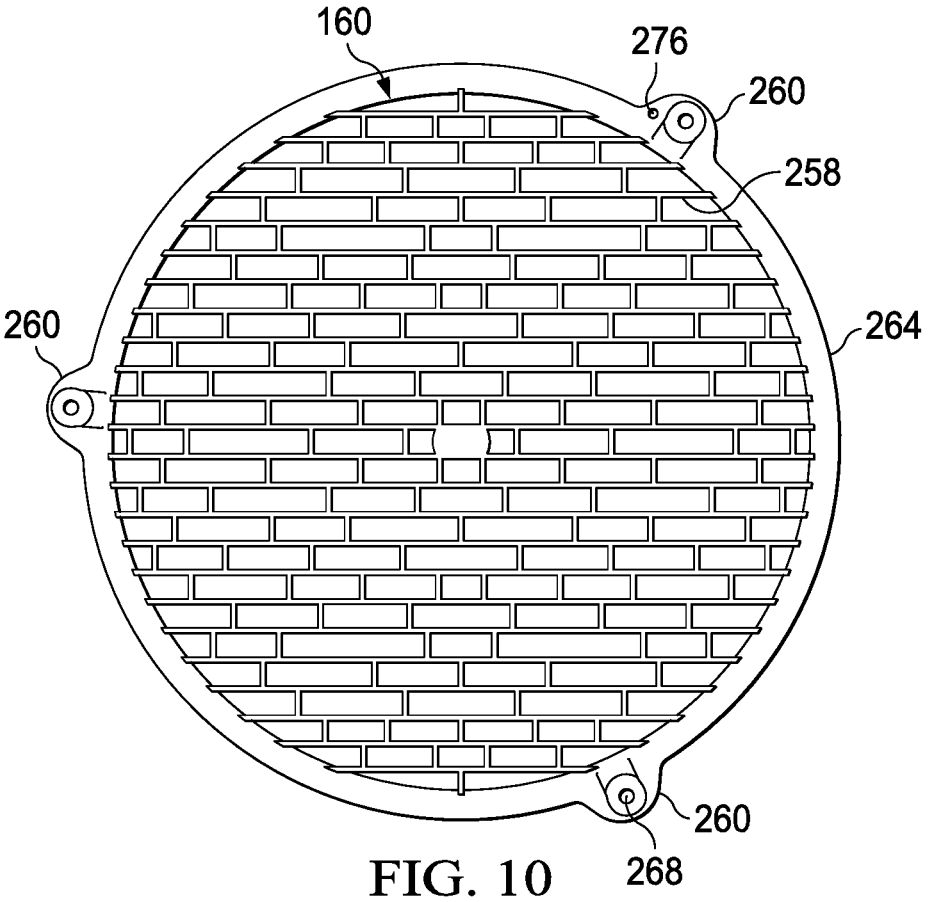
FIG. 10 is schematic a plan view from a back side of an illustrative embodiment of a guard member.

Referring now primarily to FIGS. 5 and 10, an illustrative embodiment of the guard member 160 is shown. The guard member 160, which has a grill portion 258, includes a plurality of guard attachment tabs 260, or members, formed on the periphery 264 of the guard member 160. Each of the plurality of attachment tabs 260 is formed with an attachment aperture 268. The attachment apertures 268 of the plurality of guard attachment tabs 260 receive the plurality of stud inserts 244 and the plurality of main nuts 252 are coupled to the stud inserts 244 outboard of the guard attachment tabs 260 when in the assembled position.

In some embodiments, it may be desirable to have the guard member 160 attached to the panel 140 in a particular orientation as desired. This may be for aesthetics or for functionality. To make sure the technician applies the guard member 160 in the desired orientation or position, one or more of the plurality of guard attachment tabs 260 may have on it either a guard alignment pin or a guard alignment aperture and the complimentary portion on the panel 140 proximate one of the stud inserts 244. One illustrative embodiment is shown in FIGS. 5, 8, 10, 11, 12, and 13 as will now be described.

Figure 11:
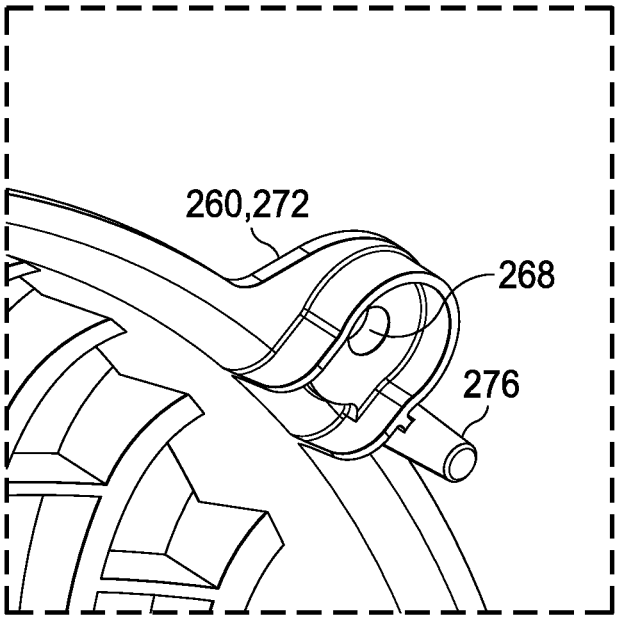
FIG. 11 is a schematic perspective view of a portion of an illustrative embodiment of a guard member and, in particular, an illustrative embodiment of a guard attachment tab having an adjacent alignment pin.

In the illustrative embodiment, one 272 of the plurality of guard attachment tabs 260 is performed with a guard alignment pin 276. FIG. 11, which is a back side of the one guard attachment tab 272 shows it best. The guard alignment pin 276 may have a wedge shape to it and extends axially inward in the assembled position. As shown best in FIG. 8, proximate one of the plurality of stud inserts 244 is an alignment aperture 280. The stud inserts 244 and alignment aperture 280 are radially outboard of the fan aperture 144. The alignment aperture 280 may be adjacent to the stud insert 244.

In this embodiment, the guard alignment pin 276 will mate with the alignment aperture 280 only when the guard member 160 is in the desired position. If a technician tries otherwise, the alignment pin 276 will not go into the panel 140 and it should be apparent that the guard member 160 is in the wrong position. Those skilled in the art will appreciate that the alignment pin could be on the panel 140 and the alignment aperture 280 on the guard attachment tab 272. In still another embodiment, the alignment pin or alignment aperture may be positioned any where on the periphery of the guard member 160.

Referring now primarily to FIG. 12, which is a back view (i.e., from the interior of the cabinet when assembled) of a portion of the panel 140, and FIG. 13, which is also a back view of the panel 140, the back of the panel 140 proximate the alignment aperture 280 is shown. In FIG. 12, one may see that a leg 188 of the motor mount 184 is extending into slot 200, and on the opposite side, the distal end 220 will interface with the stud insert 244 (back side shown in this view). In this view, the guard member 160 has not been attached. FIG. 13 is the same portion from a slightly different angle, but in this view, one may see that the guard member 160 has been attached in the desired position as indicated by the end of the alignment pin 276 extending through alignment aperture 280.

Referring again primarily to FIG. 5, one illustrative embodiment for assembling the first fan 124 of the refrigeration unit 104 will be presented. The panel 140 is shown as part of an L-shaped member that includes the top panel 142 as well. The panel 140 is formed with the fan aperture 144 and the Venturi shroud 152 may be applied around the fan aperture 144. The Venturi shroud 152 extends axially 182 outward and constricts some in the same direction as it extends from the surface 192 of the front panel 140. The motor 176 may be coupled to the motor mount 184 by positioning the plurality of mounting studs 204 through the plurality of apertures 212 and applying nuts 256. The fan blade 168 may be coupled at the attachment hub 248 to the shaft 180 of the motor 176. The motor 176, motor mount 184, and fan blade 168 comprise a fan motor assembly that can be installed then from the front of panel 140 from a position on the exterior of the cabinet 132.

The motor 176 of the fan motor assembly is inserted through fan aperture 144 and the distal ends 220, e.g., the eyelets 226, are positioned over the plurality of stud inserts 244. The guard member 160 is positioned over the first fan blade 168 with the fan blade 168 in the convex portion of the guard member 160. The plurality of guard attachment tabs 260 of the guard member 160 are aligned such that the plurality of attachment apertures 268 receive the plurality of stud inserts 244 and moreover are aligned such that the alignment aperture 280 and guard alignment pin 276 mate. The plurality of main nuts 252 are applied to the plurality of stud inserts 244. The attachment apertures 268 of the plurality of guard attachment tabs 260 interface with the plurality of stud inserts 244 and the plurality of main nuts 252 are coupled to the stud inserts 244 outboard (more exterior) of the guard attachment tabs 260 when in the assembled position.

This would complete this portion of the assembly. Importantly, reversing this process provides distinct advantages in the field. It provides easy access to the fan motor assembly. If a repair or service is required in the field, the technician may remove the plurality of main nuts 252, and that will allow the guard member 160 to be removed and then the fan motor assembly (motor 176, motor mount 184, and family 168) to be removed as a unit from the front exterior of the refrigeration unit 104. The technician may then remove the fan motor assembly from the cold environment to service or repair it as may be needed. In another scenario, the technician may remove the fan motor assembly, in order to better clean or view aspects of the evaporator coil that reside behind the motor 176 in the interior 172 of the cabinet 132.

In one illustrative embodiment, a refrigeration unit includes a cabinet having a front panel and an evaporator coil disposed within an interior of the cabinet. The refrigeration unit further includes a round fan aperture formed in the front panel; a fan blade; a motor having a shaft extending toward an exterior of the cabinet when in an assembled position and a plurality of attachment studs; and a motor mount. The motor mount has a hub portion and a plurality of legs extending from the hub portion radially outward and axially towards the exterior of the cabinet when in an assembled position. Each of the plurality of legs has a first end and a second end, and the first ends are coupled to the hub portion. The motor mount hub is coupled to the plurality of attachment studs of the motor. The second ends of the plurality of legs are coupled to the front panel.

Unless otherwise specified, any use of any form of the terms "connect," "engage," "couple," "attach," or any other term describing an interaction between elements is not meant to limit the interaction to direct interaction between the elements and may also include indirect interaction between the elements described. In the discussion herein and in the claims, the terms "including" and "comprising" are used in an open-ended fashion, and thus should be interpreted to mean "including, but not limited to."

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description herein is, therefore, not to be taken in a limiting sense, and the scope of the present invention is defined only by the claims.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A refrigeration unit comprising:

a cabinet having a plurality of panels forming an interior space;

a motor having a shaft and a plurality of mounting studs;

wherein a first panel of the plurality of panels is formed with a fan aperture therethrough;

a Venturi shroud formed on the first panel around the fan aperture, wherein the Venturi shroud extends axially outward from the cabinet;

a motor mount comprising:

a central motor mounting member having a plurality of apertures for receiving the plurality of mounting studs on the motor, a plurality of legs, each having a distal end and a proximal end, wherein the proximal ends of the legs are coupled to the central motor mounting member and the distal ends are coupled to the first panel radially outboard of the fan aperture when in an assembled position, and wherein the proximal ends of the plurality of legs are axially closer to the motor than the distal ends of the plurality of legs when in the assembled position;

wherein the Venturi shroud is formed with a plurality of slots, each slot of the plurality of slots sized to allow one of the plurality of legs of the motor mount to enter the slot, wherein each slot of the plurality of slots has an open end;

a fan blade coupled to the shaft of the motor; and a guard member coupled to the first panel, wherein the guard member has a convex outward facing portion and a concave interior portion, and wherein the concave interior portion covers the fan blade.

2. The refrigeration unit of claim 1, wherein the plurality of legs is curved 180 degrees between the distal ends and the proximal ends.

3. The refrigeration unit of claim 1, further comprising a plurality of eyelets formed on the distal ends of the plurality of legs of the motor mount.

4. The refrigeration unit of claim 1, further comprising a plurality of eyelets formed on the distal ends of the plurality of legs of the motor mount; wherein a plurality of stud inserts extend from an exterior surface of the first panel; wherein the eyelets on the distal ends of the plurality of legs of the motor mount are disposed on the plurality of stud inserts extending from the first panel; and further comprising a plurality of main nuts coupled to the stud inserts outboard of the plurality of eyelets.

5. The refrigeration unit of claim 4, further comprising a plurality of guard attachment tabs formed on the periphery of the guard member and each formed with an attachment aperture, and wherein the attachment apertures of the plurality of guard attachment tabs receive the plurality of stud inserts, and the plurality of main nuts are coupled to the stud inserts outboard of the guard attachment tabs when in the assembled position.

6. The refrigeration unit of claim 4, further comprising:

a plurality of guard attachment tabs formed on the periphery of the guard member and each formed with an attachment aperture;

wherein the attachment apertures of the plurality of guard attachment tabs interface with the plurality of stud inserts and the plurality of main nuts are coupled to the stud inserts outboard of the guard attachment tabs when in the assembled position;

a guard alignment pin formed on the guard member at the periphery and extending axially inwardly or on the first panel extending axially outwardly and located radially outboard of the Venturi shroud;

an alignment aperture sized and configured to receive the guard alignment pin, wherein the alignment aperture is formed on the first panel radially outboard of the Venturi shroud or on the periphery of the guard member; and wherein the alignment aperture and alignment pin only mate when the guard member is in a desired position.

7. The refrigeration unit of claim 1, further comprising:

a plurality of stud inserts that extend from an outwardly facing surface of the first panel;

a plurality of guard attachment tabs formed on the periphery of the guard member and each formed with an attachment aperture;

wherein the attachment apertures of the plurality of guard attachment tabs receive the plurality of stud inserts and are coupled thereto when in the assembled position;

a guard alignment pin formed on the guard member at the periphery and extending axially inwardly or formed on the first panel extending axially outwardly and located radially outboard of the Venturi shroud;

an alignment aperture sized and configured to receive the guard alignment pin, wherein the alignment aperture is formed on the first panel radially outboard of the Venturi shroud or on the periphery of the guard member; and wherein the alignment aperture and alignment pin only mate when the guard member is in a desired assembly position.

8. The refrigeration unit of claim 1, wherein in the assembled position, the central motor mounting member is displaced parallel to the shaft of the motor inwardly a distance of at least 0.25 inches from the distal ends of the plurality of legs of the motor mount.

9. The refrigeration unit of claim 1, wherein in the assembled position, the central motor mounting member is displaced parallel to the shaft of the motor a distance of at least 0.25 inches from the distal ends of the plurality of legs of the motor mount, and the inwardly distance from the distal ends of the plurality of legs to a most inward portion of the plurality of legs is at least 0.5 inches.

10. The refrigeration unit of claim 1, wherein the slots have a V-shape.

11. The refrigeration unit of claim 1, wherein the plurality of legs is curved;

a plurality of eyelets formed on the distal ends of the plurality of legs of the motor mount;

wherein a plurality of stud inserts extends axially outward from an exterior surface of the first panel;

wherein the eyelets on the distal ends of the plurality of legs of the motor mount are disposed on the plurality of stud inserts extending from the first panel;

a plurality of main nuts coupled to the stud inserts axially outboard of the plurality of eyelets;

a plurality of guard attachment tabs formed on the periphery of the guard member and each formed with an attachment aperture;

wherein the attachment apertures of the plurality of guard attachment tabs receive the plurality of stud inserts and the plurality of main nuts are coupled to the stud inserts outboard of the guard attachment tabs;

a guard alignment pin formed on the guard member at the periphery and extending axially inward or on the first panel extending axially outwardly and located radially outboard of the Venturi shroud;

an alignment aperture sized and configured to receive the guard alignment pin, wherein the alignment aperture is formed on the first panel outboard of the Venturi shroud or on the periphery of the guard member;

wherein the alignment aperture and alignment pin only mate when the guard member is in a desired assembly position; and wherein in the assembled position, the central motor mounting member is displaced parallel to the shaft of the motor axially inward a distance of at least 0.25 inches from the distal ends of the plurality of legs of the motor mount, and the distance from the distal ends of the plurality of legs to a most axially inward portion of the plurality of legs is at least 0.5 inches.

12. The refrigeration unit of claim 11, wherein the guard alignment pin is wedge shaped.

13. A method for servicing a portion of a refrigeration unit, the method comprising:

wherein the refrigeration unit comprises:

a cabinet having a plurality of panels forming an interior space, a motor having a shaft and a plurality of mounting studs extending axially outward, wherein a first panel of the plurality of panels is formed with a fan aperture therethrough, a shroud formed on the first panel around the fan aperture and extending axially outward, a motor mount comprising:

a central motor mounting member having a plurality of apertures for receiving the plurality of mounting studs, a plurality of legs, each having a distal end and a proximal end, wherein the proximal ends of the legs are coupled to the central motor mounting member and the distal ends are coupled to the first panel radially outboard of the fan aperture when in an assembled position, and wherein the proximal ends of the plurality of legs are axially closer to the motor than the distal ends of the plurality of legs when in the assembled position, wherein the shroud is formed with a plurality of slots, each slot of the plurality of slots sized to allow one of the plurality of legs of the motor mount to enter the slot, a fan blade coupled to the shaft of the motor, a guard member coupled to the first panel, wherein the guard member has a convex outward facing portion and a concave interior portion, and wherein the concave interior portion covers the fan blade, a plurality of eyelets formed on the distal ends of the plurality of legs of the motor mount, wherein a plurality of stud inserts extends outwardly from an exterior surface of the first panel, wherein the eyelets on the distal ends of the plurality of legs of the motor mount are disposed on the plurality of stud inserts extending from the first panel, a plurality of main nuts coupled to the stud inserts outboard of the plurality of eyelets, a plurality of guard attachment tabs formed on the periphery of the guard member and each formed with an attachment aperture, and wherein the attachment apertures of the plurality of guard attachment tabs receive the plurality of stud inserts, and wherein the plurality of main nuts are coupled to the stud inserts on an exterior side of the guard attachment tabs;

removing the main nuts;

removing the guard member; and removing the fan blade, motor mount, and motor as a unit from an interior of the cabinet.

14. A refrigeration unit comprising:

a cabinet having a front panel;

an evaporator coil disposed within an interior of the cabinet;

a round fan aperture formed in the front panel;

a fan blade;

a motor having a shaft extending toward an exterior of the cabinet when in an assembled position and a plurality of attachment studs;

a motor mount having a hub portion and a plurality of legs extending from the hub portion radially outward and axially towards the exterior of the cabinet when in an assembled position, each of the plurality of legs having a first end and a second end, wherein the first ends are coupled to the hub portion;

wherein the motor mount hub is coupled to the plurality of attachment studs of the motor; and wherein the second ends of the plurality of legs are coupled to the front panel, and in an assembled position, the motor is only supported by the plurality of legs;

a Venturi shroud formed on the front panel around the fan aperture, wherein the Venturi shroud extends axially outward from the cabinet; and wherein the Venturi shroud is formed with a plurality of slots, each slot of the plurality of slots sized to allow one of the plurality of legs of the motor mount to enter the slot, wherein each slot of the plurality of slots has an open end.

15. The refrigeration unit of claim 14, further comprising:

a plurality of attachment studs extending from the front panel; and wherein the second ends of plurality of legs are coupled to the attachment studs extending from the front panel.

16. The refrigeration unit of claim 14, further comprising:

a plurality of attachment studs extending from the front panel; and wherein the second ends of plurality of legs are coupled to the attachment studs extending from the front panel;

a guard member forming a concave basket over the fan blade when in the assembled position;

wherein the guard member comprises a plurality of attachment points on a periphery of the guard member having attachment apertures;

wherein the attachment apertures of the attachment points of the guard member receive a portion of the plurality of attachment studs; and a plurality of main nuts coupled to the attachment studs axially outboard of the attachment apertures of the guard member.

17. The refrigeration unit of claim 14, wherein each of the plurality of legs curve 180 degrees from the first end to the second end.

18. The refrigeration unit of claim 14, further comprising:

a plurality of attachment studs extending from the front panel;

wherein the second ends of plurality of legs are coupled to the attachment studs extending from the front panel;

a guard member forming a concave basket over the fan blade when in the assembled position;

wherein the guard member comprises a plurality of attachment points on a periphery of the guard member having attachment apertures;

wherein the attachment apertures of the attachment points of the guard member receive a portion of the plurality of attachment studs;

a plurality of main nuts coupled to the attachment studs axially outboard of the attachment apertures of the guard member;

wherein each of the plurality of legs curve 180 degrees from the first end to the second end; and a Venturi surrounding and proximate to the fan aperture on the front panel and extending axially outward from a surface of the front panel, and wherein the Venturi is formed with a plurality of slots for receiving a portion of the plurality of legs of the motor mount.

* * * * *